United States Patent [19]

Woodruff

[11] 4,445,830

[45] May 1, 1984

[54] RADIAL VANE PUMP HAVING VARIABLE DISPLACEMENT

[75] Inventor: Frank Woodruff, New Hartford, N.Y.

[73] Assignee: The Bendix Corporation, Teterboro, N.J.

[21] Appl. No.: 409,007

[22] Filed: Aug. 17, 1982

[51] Int. Cl.[3] ..... F04C 2/00; F04C 15/04

[52] U.S. Cl. ..... 418/22; 418/210

[58] Field of Search ..... 418/1, 16, 22, 23, 24, 418/25, 26, 27, 19, 210, 215

[56] References Cited

U.S. PATENT DOCUMENTS 2,570,411 10/1951 Vickers ..... 418/159

FOREIGN PATENT DOCUMENTS 567845 10/1977 U.S.S.R. ..... 418/16

*Primary Examiner*—John J. Vrablik
*Assistant Examiner*—T. Olds
*Attorney, Agent, or Firm*—Anthony F. Cuoco; Thomas L. Adams

[57] ABSTRACT

A variable displacement vane pump includes a rotor (10) rotatably mounted in a casing (32). The casing (32) has a pair of relatively rotatable complementary cams (18,20). Each cam (18,20) has a surface shaped to provide an annular curvilinear track. The pump also has a first (14) and second (16) plurality of vanes slidably mounted upon the rotor (10). Each of the vanes (14,16) is sized and positioned to engage a corresponding cam (18,20). These vanes (14,16) are constrained in a radial direction by the cams (18,20) as the rotor (10) rotates. The vanes of the first (14) plurality engage one (18) of the cams, the other one (20) of the cams being engaged by the vanes of the second plurality (16).

21 Claims, 8 Drawing Figures

RADIAL VANE PUMP HAVING VARIABLE DISPLACEMENT

BACKGROUND OF THE INVENTION

The present invention relates to variable displacement vane pumps and, in particular, to pumps having rotors carrying radially slidable vanes.

Vane pumps are well known. In a very simple form, a pumping rotor carries vanes around a casing having a cylindrical volume which is eccentric to the center of rotation of the rotor. This eccentricity results in the volume between vanes changing cyclically. With ports in the casing positioned appropriately, the changing volume between vanes can cause pumping. In a known rotary pump, the extent of eccentricity between rotor and casing can be changed to alter the pumping displacement. While a very successful type of pump, it develops a high radial load on the rotor, requiring massive bearings whose high weight is unsuitable for aircraft and other applications. A balanced vane pump, however, is symmetrical about any diameter and since it applies no radial load to its journal bearings, it is much lighter.

Another known pump employs a rotor having along its periphery axial slots carrying vanes which are axially reciprocatable within the slots. A coaxial cam in the shape of a truncated cylinder lies alongside these vanes and directs their axial reciprocation at the rate of one cycle per revolution of the rotor. While this arrangement can be set to change the phasing of the vanes and the associated volume between them, this phasing change has some disadvantages. When the phasing is changed to reduce pump displacement, the fluid being pumped is pressurized and depressurized non-productively, thereby increasing the load on the various moving parts and pump bearings.

Another known fluid motor or pump has a duplex construction. This construction includes two cams on opposite sides of a blade carrier, forming two working chambers. The blade carrier has two circumferential series of separate blades. However, this known device does not provide for relative rotation between the different cams to change the displacement of a pump. Thus this design suffers the unnecessary loading mentioned previously.

It is also known to alter the displacement of a vane pump by distorting the surface of its cam. A disadvantage with such distortions is that the peak acceleration and thus the forces applied to the vane varies significantly as the cam is distorted. Thus vane wear increases as the cam is distorted to non-ideal configurations.

Accordingly, there is a need for a variable displacement, preferably balanced, vane pump which has a cam surface that does not create undue acceleration and stress. This pump ought to be able to vary the displacement and reduce the input power when the flow of the pump is reduced. Furthermore the pump ought to be simple, efficient and reliable.

SUMMARY OF THE INVENTION

In accordance with the illustrative embodiment demonstrating features and advantages of the present invention there is provided a variable displacement vane pump having a ported casing and a rotor rotatably mounted in the casing. The ported casing has a pair of relatively rotatable, complementary cams. Each cam has a surface shaped to provide an annular curvilinear track. The pump also includes a first and second plurality of vanes slidably mounted upon the rotor. Each of the vanes is sized and positioned to engage a corresponding one of the pair of cams. These vanes are constrained in a radial direction by the cams as the rotor rotates. The vanes of the first plurality engage one of the cams, the other cam being engaged by the vanes of the second plurality.

According to a related method of the same invention, variable displacement pumping is performed with a plurality of pairs of reciprocatable vanes. These vanes are rotatably mounted in a ported casing having a pair of rotatable cams. The method includes the step of moving each pair of vanes in a closed path within the casing. The vanes of each pair ride on different ones of the cams and reciprocate radially. The method also includes a step of rotating the cams with respect to each other to alter the phasing of the vanes in each pair of vanes.

By employing such apparatus and method a relatively simple, efficient and reliable variable displacement pump is provided. In a preferred embodiment, a cylindrical rotor having radial slots carries in each slot a pair of vanes. In this preferred embodiment, vanes can engage a pair of cams encircling the pairs of vanes. The cams are part of a hollow cylindrical casing having intake and discharge ports. Due to the varying thickness of the cams, a varying volume exists between vanes. Since the volume varies as the vanes revolve, the pump can displace fluids from one port to the other. In this preferred embodiment, the vanes are radially reciprocatable.

When the vanes in each pair are synchronized to act constructively, the displacement volume is maximum. However, in the preferred embodiment the cams can be rotated with respect to the ports, in opposite and equal directions. As a consequence the volumes are out of phase and destructively interfere to some extent. However this interference means that the pump does not create unnecessary pressure. Only that volume of fluid which will be discharged from the pump will be raised to discharge pressure.

Also in this preferred embodiment, the radially reciprocatable vanes have two different radial dimensions. Consequently, the associated pair of cams are sized differently. A highly preferred pair of cams each have a generally elliptical bore wherein the major diameter of one cam exceeds that of the other. This feature is significant since it assures that vanes follow only their own cam and do not become caught on the neighboring cam.

This preferred pump uses a pair of rotatable, annular cams each having an annular outside shoulder with part of it cut to form the teeth of a rack. A pinion gear spanning the racks of the two cams can be rotated to drive the cams in equal but opposite directions.

It is especially desirable to have an even number of cycles per revolution of the pump so that the forces applied to its bearings are balanced, greatly reducing their size and wear, and enhancing their reliability.

In a preferred embodiment, a "shadow" discharge port communicates to a circular groove in a port plate facing the rotor. This groove communicates to the underside of the vanes so that discharge pressure acts to drive the vanes outwardly so that they make good sealing contact with their associated cams.

BRIEF DESCRIPTION OF THE DRAWINGS

The above brief description as well as other objects, features and advantages of the present invention will be more fully appreciated by reference to the following detailed description of the presently preferred but nonetheless illustrative embodiment in accordance with the present invention when taken in conjunction with the accompanying drawings wherein.

DETAILED DESCRIPTION OF THE PREFERRED EMBODIMENT

Figures 1, 2:
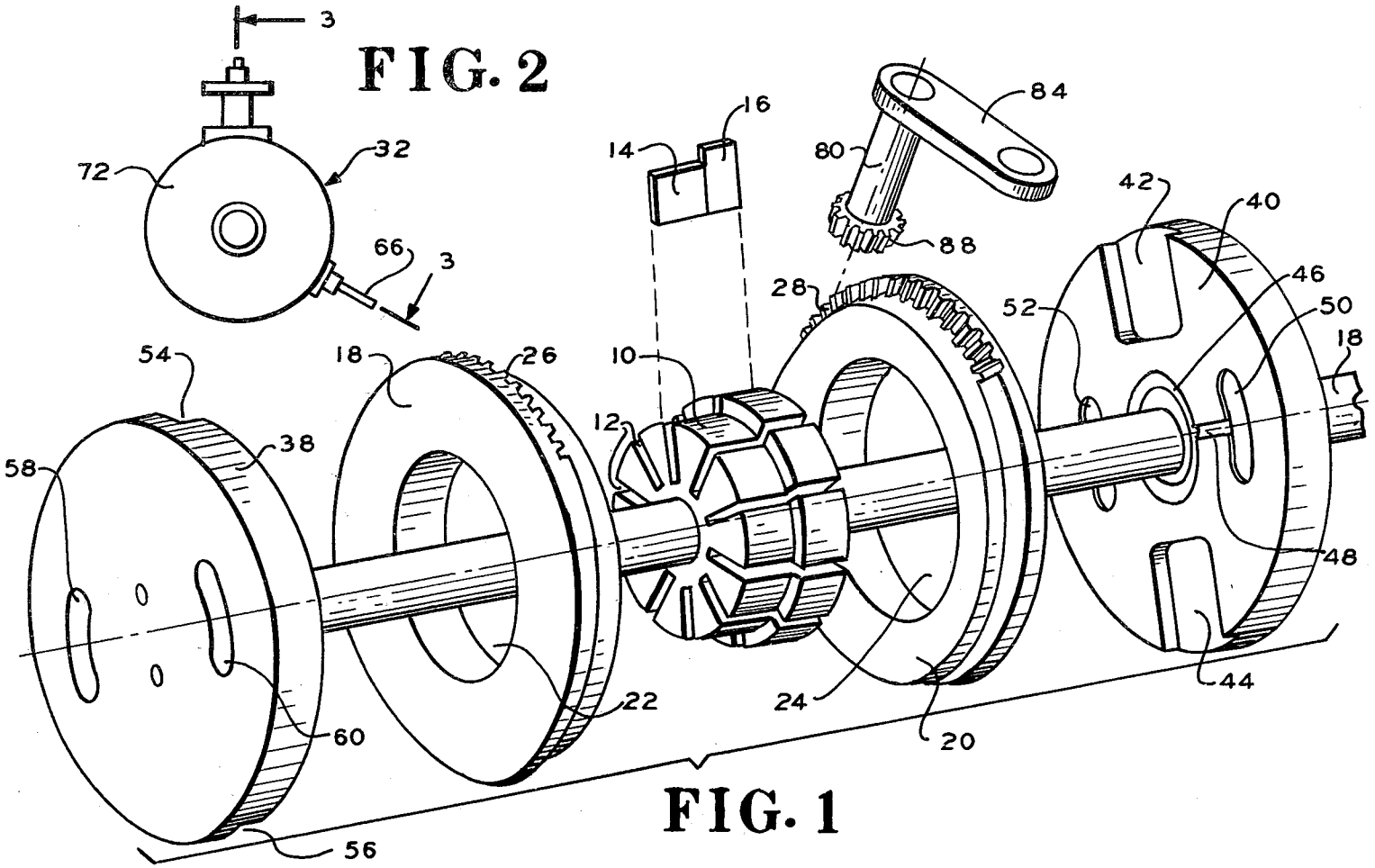
FIG. 1 is an exploded perspective view of internal components for a pump according to the principles of the present invention.
FIG. 2 is a reduced scale, end view of the pump after installation of the components of FIG. 1.
Figure 4:
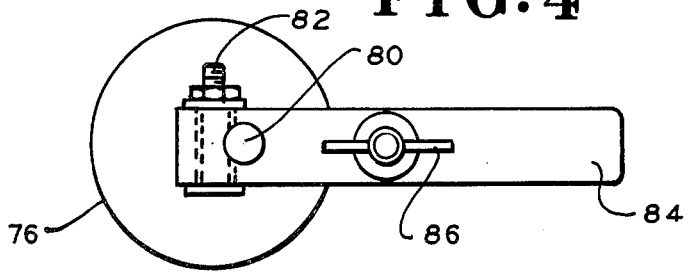
FIG. 4 is a top view of the pump of FIG. 3 showing only the linkage means thereof.

Referring to FIGS. 1, 2, 3 and 4, a variable displacement pump is illustrated. A rotor 10 is shown herein as a drum having the shape of a pair of contiguous coaxial cylinders, one having a larger outside diameter. Rotor 10 has in this embodiment ten slots 12 which are radially aligned and which run the full axial length of rotor 10. It will be appreciated that other numbers of slots may be employed in different embodiments. Fitted into slots 12 are a first and second plurality of vanes, one from each plurality being paired together as shown by vanes 14 and 16. In this embodiment, vanes 14 and 16 are rectangular plates wherein vane 14 is wider and shorter than vane 16. Accordingly, they each exhibit equivalent exposed surface area. The vanes 14 and 16 are taller than the corresponding depth of slots 12 so that the vanes extend out of slots 12. While vanes 14 and 16 are shown having a rectangular plan, it will be appreciated that in other embodiments this shape can be altered depending upon the surfaces they interact with and the shape of the corresponding rotor.

Encircling rotor 12 and vanes 14 and 16 are a pair of complementary cams 18 and 20, each having bores 22 and 24, respectively. Bore 24 has a major diameter which exceeds that of bore 22. In this embodiment bores 22 and 24 have a generally elliptical shape so that they each provide an annular curvilinear track. It will be appreciated that other shapes may be employed. For example, in a four cycle pump the bores will have 4 lobes. Furthermore the bores need not be mathematically perfect ellipses but may be of a different shape to limit the acceleration of the vanes. The periphery of cams 18 and 20 are circular and have a shoulder, over a portion of which teeth are cut to form racks 26 and 28, respectively. Racks 26 and 28 extend at least 45°. Rotor 10 has internal splines that allow limited axial motion along the complementary external splines at the inside end of shaft 18 (FIG. 2). (Shaft 18, as illustrated in FIG. 1, is exaggerated in length and is merely schematic of the actually employed shaft). Shaft 18 is supported in a pair of bearings 30 which are held in a bearing cavity in ported casing 32. Ported casing 32 has a generally cylindrical shape with a reduced diameter or neck portion containing bearings 30. Bearings 30 are held in position by a lock knot 34 affixed to shaft 18. Cams 18 and 20 fit snugly within an annular spacer 36 which fits against the inside surface of casing 32.

Rotor 10 is sandwiched between a pair of port plates 38 and 40. Port plate 40 has a pair of diametrically opposed inlet ports shown herein as canals 42 and 44. Canals 42 and 44 are cut on the inside face of plate 40 to follow radial paths, each reaching the periphery of plate 40. Plate 40 also has a channel in the shape of concentric inner groove 46. Another channel 48 communicates with a shadow discharge port shown herein as circumferentially elongated, diametrically opposed hollows 50 and 52 which are orthogonal to inlets 42 and 44. A channel similar to channel 48 connects shadow discharge port 52 with channel 46.

Port plate 38 has a pair of inlet canals 54 and 56 that mirror canals 42 and 44 of port plate 40. Port plate 38 also has a pair of circumferentially elongated, diametrically opposed outlet ports 58 and 60 in the form of slots passing through the entire thickness of plate 38. Ports 50, 52, 58 and 60 are positioned radially to span the gap between cams 18 and 20 and rotor 10. Ports 50, 52, 58 and 60 extend over approximately 45° of port plate 38.

Casing 32 has an opening 62 containing fitting 64 which carries inlet pipe 66. Also cut along 180° of casing 32 are a pair of internal, parallel, right-semicircular grooves 68 and 70 which connect together ports 44 and 42 and ports 56 and 54 to the opening 62 of casing 32. A rib 76 (FIG. 3) runs between grooves 68 and 70 to support spacer 36. The open end of casing 32 near plate 38 is closed by a back plate 72 which has a central discharge outlet 74. Belleville type washer 90 is mounted between cover plate 72 and port plate 38 to urge the latter inwardly. Plates 38 and 40 are keyed, splined, employ pilot pins or are otherwise indexed so they cannot rotate within casing 32.

A bushing 76 has the shape of a spool with a lower, outwardly extending sleeve 78 that fits into the side of casing 32. Contained within bushing 76 is shaft 80 which has a notch therein through which a bolt 82 slides. (Shaft 80 and its supported parts are not sectioned). Bolt 82 is connected through the pivot end of handle 84 which has lower tab 88 threadably secured by wing nut 86. Tightening wing nut 86 causes tab 88 to grip the upper flange of spool 76 and thereby prevent motion of handle 84. Shaft 80 is part of a linkage means and has on its inside end a pinion 88 which engages previously mentioned racks 26 and 28.

Figure 5A:
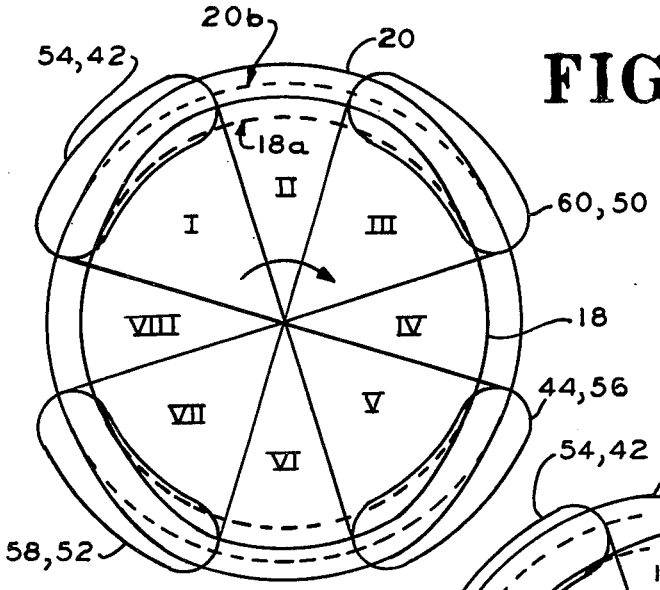
FIGS. 5A, 5B and 5C are schematic diagrams showing the changing volume within the pump of FIG. 3 for the conditions of maximum, moderate and minimum pumping, respectively.

To facilitate an understanding of the principles associated with the foregoing apparatus, its operation will now be briefly described. As the shaft 18 spins, vanes 14 and 16 are initially thrown outwardly under centrifugal force, although as explained hereinafter other pressure effects assist this centrifugal force. It will be assumed initially that the cams 18 and 20 are oriented with their major diameters parallel. This situation corresponds to that illustrated in FIG. 5A. Notice that the major diameters of cams 18 and 20 therein are aligned and separate ports 52, 58, 54, and 42 from ports 60, 50, 44 and 56. Cam surfaces 18 and 20 have inscribed therein in FIG. 5A circular reference lines **18*a* and 20*b*, respectively. These reference lines are tangent at the points of intersection of the cam surfaces with their minor diameters. Therefore these reference lines suggest the relative changes in volume between the cam surface and the rotor (not illustrated in this view). This relative orientation of FIG. 5A is achieved by rotating handle 84 (FIG. 3) and thus pinion 88 until cams 18 and 20 are positioned as illustrated. The setting may be conveniently ascertained by suitable markings on the upper surface of spool 76**.

Referring to region I in FIG. 5A, a region encompassing inlets 54 and 42, the volume is increasing, assuming vanes rotate in the direction of the illustrated arrow. Accordingly, increasing intervane volumes of region I tend to draw fluid inwardly. In region II, intervane volume does not change significantly which is important since there are no ports available to relieve any excess pressure (positive or negative) occurring in this region. In region III, cam surfaces 18 and 20 move inwardly thereby decreasing the effective volume. Accordingly, there is a discharge delivered to outlet ports 60 and 50. This sequence is followed by region IV wherein the volume is near minimum and does not appreciably change. This feature again assures that there is little non-productive compression (or decompression) occurring in this region where no ports are available. Thus only fluid to be discharged is pressurized.

Figure 3:
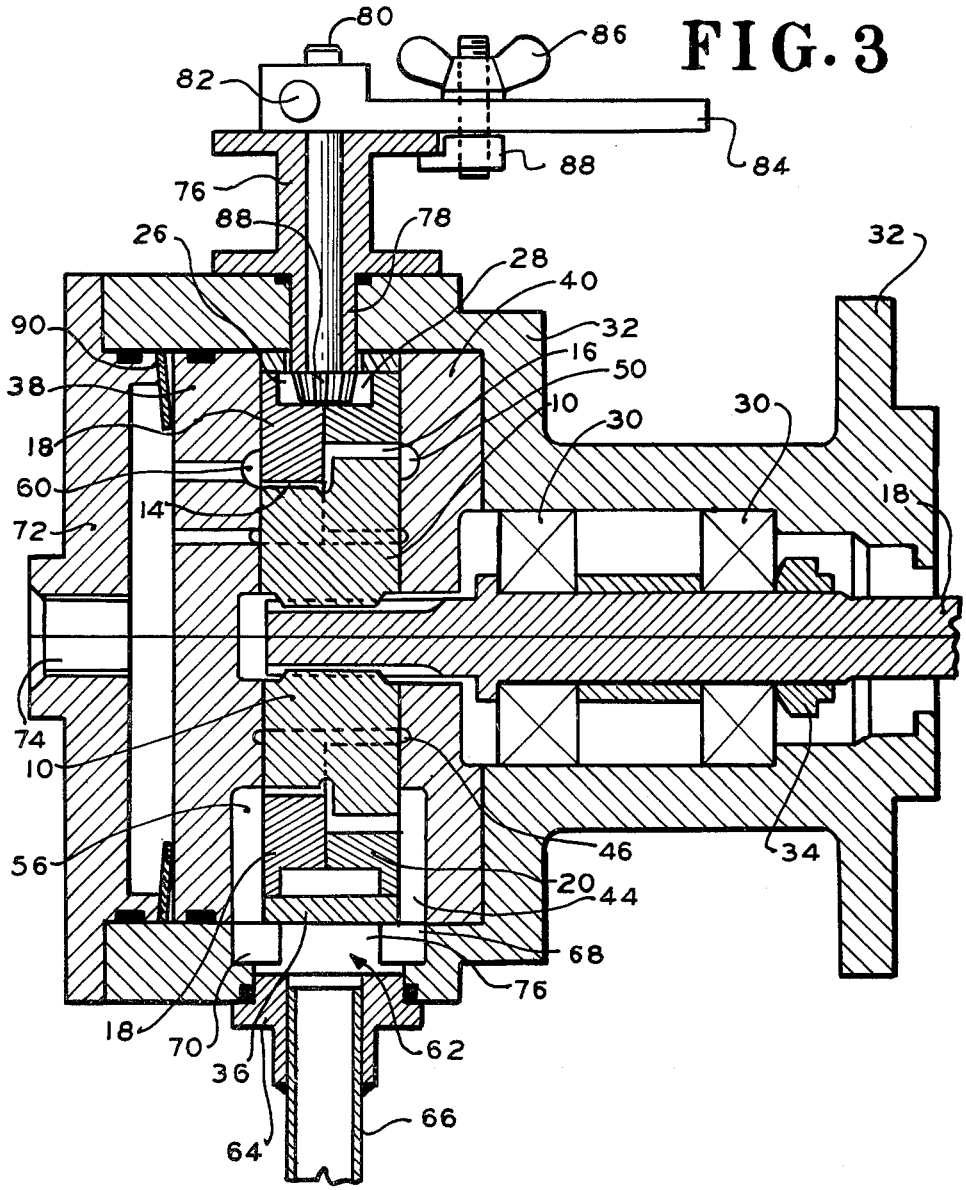
FIG. 3 is a composite cross-sectional view taken along lines 3—3 of FIG. 2.

The foregoing describes one pumping cycle which is then repeated through areas V through VIII. The foregoing creates significant pressure in shadow discharge port 50 (FIG. 1) which pressurizes groove 46 (FIG. 3). This pressure communicates to the underside of vanes 14 and 16 to drive them radially outward and cause a tight seal against cams 18 and 20, respectively. The high discharge pressure existing in the interspace between plate 72 and port plate 38 (FIG. 3) drives plate 38 toward rotor 10 and port plate 40 to cause a good seal among and between these elements. This sealing effect is facilitated by rotor 10 floating somewhat on its splines. Accordingly, there is a pressure differential so that fluid flows from inlet pipe 66 to outlet 74.

Figure 5B:
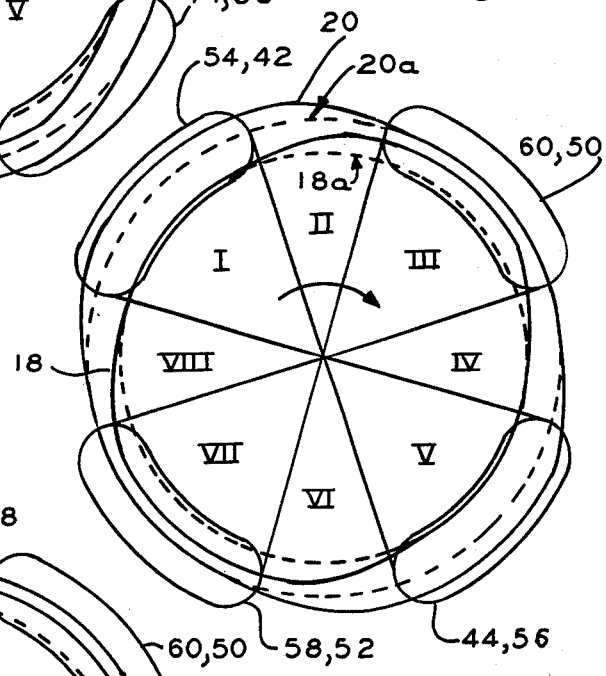

It is now assumed that wing nut 86 (FIG. 3) is loosened and handle 84 turned before retightening wing nut 86. The specific movement is chosen to cause cams 18 and 20 to each rotate 22.5° in opposite directions. This situation is illustrated in FIG. 5B wherein the major diameters of cams 20 and 18 are shown displaced by 45°. Referring to region I of FIG. 4B, the volume associated with cam surface 20 increases only moderately but is essentially near maximum throughout that region. On the other hand, the volume associated with cam surface 18 is near its minimum but increasing only moderately. Accordingly, the suction caused in region I is less than that previously described for FIG. 5A. In region II of FIG. 5B, the volume associated with cam surface 20 is generally decreasing while that of cam surface 18 is generally increasing. However, these volume changes destructively interfere so that the net volume change is moderate. This means that there is relatively little volume change in region II. This important feature avoids unnecessary compression and only that volume to be discharged is raised to discharge pressure. In region III, volumes associated with cams 18 and 20 both decrease. However, the volume associated with cam 20 is near its minimum and decreases only moderately while the volume associated with cam surface 18 is near its maximum and also decreases only moderately. Again, region IV is similar to region II in that the volumes are changing but in a destructive fashion so that the net volume change is slight. Again, region V through VIII are a repetition of region I through IV.

Figure 6:
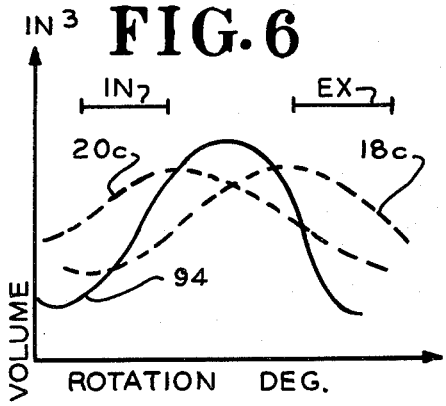
FIG. 6 is a graphical representation of the volume changes with respect to rotation for the pump of FIG. 3.

Referring to FIG. 6, the effect of the foregoing displacement of cams 18 and 20 to the position illustrated in FIG. 5B is illustrated graphically. In this diagram, the change in incremental volume (for example, the volume between adjacent vanes) is shown as a function of the angular rotation of the rotor. The inlet and discharge intervals are shown herein as segments IN and EX, respectively. The volume associated with cam 20, shown as plot **20*c*, has a peak upstream of that of cam 18, as shown by its plot 18*c*. The net volume, illustrated as curve 94, exhibits an amplitude less than what would exist were plots 18*c* and 20*c*** in phase. However, even in the illustrated out of phase condition, the net peak remains approximately centered between inlet interval IN and discharge interval EX. These plots (which are directly related to spatial distribution of volume and volume displaced per revolution) show there is no unnecessary compression occurring between the inlet and discharge intervals. Furthermore with the pump balanced, the bearings can be of a modest design and their reliability will be correspondingly increased.

Figure 5C:
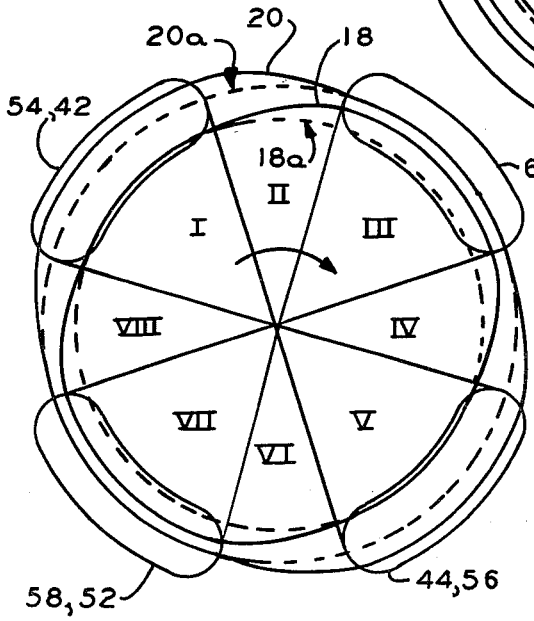

If cams 18 and 20 are rotated further, their major diameters become orthogonal as illustrated in FIG. 5C. Consequently, the volume changes along cams 18 and 20 will be oppositely phased. That is, volume associated with one cam will be increasing while the other is decreasing at the same rate. As a result, there will be no net volume change so that the pump is inoperative. The fluids contained within the pump will merely circulate with the rotor between the vanes.

It is to be appreciated that various modifications may be implemented with respect to the above described preferred embodiment. For example, the number of lobes on the cams may be changed depending upon the desired number of cycles per revolution. It is preferred that the cycles be even in number. Also, it is expected that the shape of the rotor can be altered, as well as the vanes, to accomodate other cams and port plates. Also while a pinion and rack are shown herein for rotating the cams, it is expected that alternate linkages may be employed. Furthermore, while bearings are shown on one side of the pump, it is expected that in other embodiments the bearings may be symmetrically disposed about the rotor. Also, while the preferred embodiment has port plates, in some embodiments the casing may be formed with intergral channels and apertures that perform a similar function. Also while most of the components described herein are fabricated from metal such as steel and aluminum, it is expected that in other embodiments different metals, plastics, ceramics or other materials may be employed instead, depending upon the desired strength, weight, corrosion resistance, thermal stability, speed of operation etc. Moreover, the size and relative proportions of various components illustrated herein may be altered depending upon the desired pump volume, speed of operation, weight etc.

Obviously, many modifications and variations of the present invention are possible in light of the above teachings. It is therefore to be understood that within the scope of the appended claims, the invention may be practiced otherwise than as specifically described.

What is claimed is:

1. A variable displacement vane pump comprising:

a ported casing having a pair of relatively rotatable complementary cams, each having an annular shape and a surface shaped to provide an annular curvilinear track;

a rotor rotatably mounted in said casing, said annular shaped cams encircling said rotor;

a first and second plurality of vanes slidably mounted upon said rotor, each of said vanes being sized and positioned to engage a corresponding one of said pair of cams, said vanes being constrained in a radial direction by said cams as said rotor rotates, the vanes of the first plurality engaging one of the cams, the other one of the cams being engaged by the second plurality; and said vanes being grouped into a combined plurality of circumferentially spaced pairs, each of the pairs comprising one from each of the first and the second plurality of vanes, the vanes within each pair being sized differently and positioned adjacently.

2. A pump according to claim 1 wherein the major inside diameter of one of said cams exceeds that of the other.

3. A pump according to claim 2 further comprising:

linkage means connected to said cams for relatively rotating them in opposite directions.

4. A pump according to claim 3 wherein each of said cams has a peripheral, complementary, opposing rack, said linkage means including a pinion engaging the rack of each of said cams for rotating them in opposite directions.

5. A pump according to claim 1 wherein the cams each have an elliptical bore.

6. A pump according to claim 1 wherein said casing includes an outlet port, said outlet port communicating to a location between said rotor and said vanes to urge the latter outwardly.

7. A pump according to claim 6 wherein said casing comprises:

a port plate adjacent said rotor and having a passage communicating to an inner portion of said vanes from an outer portion thereof.

8. A pump according to claim 7 wherein said passage comprises a circular inner groove communicating with a hollow having a circumferential length of less than 180°.

9. A pump according to claim 1 or 6 wherein said casing comprises:

a pair of port plates on either side of said rotor, at least one of said plates having a pair of diametrically opposed, circumferentially elongated channels, at least one of said plates having on its inside face a pair of diametrically opposed canals that extend to the periphery of the associated one of said plates.

10. A pump according to claim 1 wherein each adjacent pair of said vanes are mounted in said rotor to inhibit fluid flow therebetween.

11. A pump according to claim 10 wherein said rotor has a plurality of equiangular, radial slots extending the full axial length of said rotor, said slots being sized to fit a pair of said vanes.

12. A pump according to claim 1 wherein each of said cams has along its annular track a thickness that varies circumferentially but not axially.

13. A pump according to claim 1 wherein said casing has at least one port and said cams are relatively rotatable in opposite directions with respect to said one port.

14. A pump according to claim 13 comprising: linkage means connected to said cams for relatively rotating them in opposite directions with respect to said one port.

15. A pump according to claim 13 wherein said linkage means is operable to rotate said cams relatively equal amounts with respect to said one port.

16. A pump according to claim 1 wherein the vanes of the first plurality have radial lengths exceeding that of said second plurality.

17. A pump according to claim 16 wherein said rotor has the shape of a pair of contiguous coaxial cylinders of different diameters, said rotor having a plurality of radial slots.

18. A pump according to claim 17 wherein said vanes are grouped into a plurality of circumferentially spaced pairs, each of the pairs comprising one from each of the first and the second plurality of vanes, the vanes within each pair being positioned adjacently in a corresponding one of said radial slots with the taller one to the side of said rotor having the larger diameter.

19. A pump according to claim 1 wherein said casing has at least one inlet port and wherein said annular track has a thickness that varies periodically in a circumferential direction.

20. A pump according to claim 1 wherein the number of inlet ports and the cycles of variation in the thickness of said track are equal and even.

21. A pump according to claim 19 wherein said annular track is rotatable into a position where its maximum thickness is placed between two adjacent ports.

* * * * *